US007766026B2

(12) United States Patent
Boey

(10) Patent No.: US 7,766,026 B2
(45) Date of Patent: Aug. 3, 2010

(54) FAUCET CONTROL SYSTEM AND METHOD

(76) Inventor: Kum F. Boey, 758 Alta Mesa Pl., Monterey Park, CA (US) 91754

( * ) Notice: Subject to any disclaimer, the term of this patent is extended or adjusted under 35 U.S.C. 154(b) by 430 days.

(21) Appl. No.: 11/970,902

(22) Filed: Jan. 8, 2008

(65) Prior Publication Data

US 2008/0163942 A1 Jul. 10, 2008

Related U.S. Application Data

(63) Continuation-in-part of application No. PCT/US2007/070939, filed on Jun. 12, 2007.

(60) Provisional application No. 60/883,970, filed on Jan. 8, 2007, provisional application No. 60/855,002, filed on Oct. 27, 2006.

(51) Int. Cl.
*G05D 7/06* (2006.01)
*E03C 1/05* (2006.01)

(52) U.S. Cl. ..... 137/1; 137/624.11; 137/801; 251/129.04; 4/623

(58) Field of Classification Search ..... 137/624.11, 137/1, 801; 251/129.04; 4/623
See application file for complete search history.

(56) References Cited

U.S. PATENT DOCUMENTS 3,885,584 A 5/1975 Hock (Continued)

FOREIGN PATENT DOCUMENTS

JP 5205104 A 11/1993

(Continued)

OTHER PUBLICATIONS

International Search Report issued May 13, 2008, pp. 1-3.

(Continued)

*Primary Examiner*—Kevin L Lee
(74) *Attorney, Agent, or Firm*—Fulwider Patton LLP; Scott R. Hansen, Esq.

(57) ABSTRACT

A faucet control system comprises a valve apparatus, sensors or a touch panel to be activated by a user, and a controller that controls the valve apparatus. A first sensor may start fluid flow and a second sensor may alter the proportion of fluids delivered from two fluid sources. Alternatively, a first sensor may initiate hot water flow, a second sensor may initiate cold water flow, and a third sensor may initiate flow of a mixture of hot and cold water to create a warm water flow. The sensors may be activated without being touched and may include infrared sensing elements. The touch panel may be activated with hand pressure and may include electrically conductive sheets. Alternatively, hot, cold and/or warm touch sensors may be provided separately. The touch panel may have a first portion for allowing fluid flow from a cold fluid source, a second portion for allowing fluid flow from the cold fluid source and a hot fluid source, and a third portion for allowing fluid flow from the hot fluid source. The controller may include an adjustable timer so that fluid flow can be stopped automatically after a selected period of time. Other systems include a one sensor system, a two sensor system, a three sensor system and a five sensor system. In the five sensor system, one sensor activates hot water flow, another sensor activates cold water flow, and three sensors activate various levels of warm water flow.

8 Claims, 7 Drawing Sheets

U.S. PATENT DOCUMENTS

| | | | | |
|---|---|---|---|---|
| 4,921,211 | A | | 5/1990 | Novak et al. |
| 5,095,941 | A | * | 3/1992 | Betz ..... 251/129.04 |
| 5,322,086 | A | | 6/1994 | Sullivan |
| D382,941 | S | | 8/1997 | Nortier |
| 5,855,356 | A | | 1/1999 | Fait |
| 5,868,311 | A | | 2/1999 | Cretu-Petra |
| 6,019,130 | A | | 2/2000 | Rump |
| 6,047,417 | A | | 4/2000 | Derakhshan |
| 6,202,980 | B1 | | 3/2001 | Vincent et al. |
| 6,219,859 | B1 | | 4/2001 | Derakhshan |
| 6,481,983 | B1 | | 11/2002 | Miller |
| 6,753,554 | B1 | | 6/2004 | Gomes et al. |
| 6,913,203 | B2 | | 7/2005 | Delangis |
| 6,968,860 | B1 | | 11/2005 | Haenlein et al. |
| 7,228,874 | B2 | | 6/2007 | Bolderheij et al. |

FOREIGN PATENT DOCUMENTS

| | | | |
|---|---|---|---|
| JP | 2000-225162 | A | 8/2000 |

OTHER PUBLICATIONS

International Search Report issued Aug. 21, 2008, pp. 1-2.

* cited by examiner

FAUCET CONTROL SYSTEM AND METHOD

CROSS-REFERENCES TO RELATED APPLICATIONS

This application claims the benefit of U.S. Provisional Application No. 60/855,002, filed Oct. 27, 2006, and U.S. Provisional Application No. 60/883,970, filed Jan. 8, 2007. This application is also a continuation-in-part of PCT application PCT/US2007/070939, filed on Jun. 12, 2007, which is incorporated by reference herein.

FIELD OF THE INVENTION

The invention relates generally to faucets, and, more particularly, to a control system and method for controlling fluid flow to faucets.

BACKGROUND OF THE INVENTION

In many settings it is desirable to have a control system that allows for convenient control of water faucets and other water delivery fixtures. Many control systems, however, lack a means for convenient adjustment of water temperature. The ability to adjust temperature is indispensable in households, hotels, hospitals, and many work places.

One typical faucet system has handles for controlling hot and cold water flow. The user turns a "cold" water handle to initiate cold water flow. Similarly, the user turns a "hot" water handle to initiate hot water flow. The handles are fixed into place adjacent to the basin. To obtain the desired water temperature, the user manipulates the handles manually. This can be time consuming, and can take considerable effort. Also, the location of the handles is often not convenient to the user.

Persons skilled in the art have recognized a need for an improved system and method for controlling water temperature to reduce water waste, conserve energy, and promote sanitary conditions. There is also a need for a faucet control system and method that allows for flexibility in placement of a temperature or water flow control in order to accommodate use by a broad range of persons.

SUMMARY OF THE INVENTION

Briefly and in general terms, the present invention is directed to a faucet control system for and method of controlling fluid flow to a faucet spout in fluid communication with at least one fluid source. The system comprises a first valve adapted to control fluid flow from a cold fluid source to the faucet spout, a first "cold" switch that is normally deactivated and is touch activated by a user of the system, and controller. The controller may include a timer and is in communication with the first valve and the first switch. The controller is configured to open the first valve when the cold switch is activated, thereby allowing fluid flow from the cold fluid source to the faucet spout, and to close the first valve after a first selected period of time after the cold switch is deactivated, thereby preventing fluid flow from the cold fluid source to the faucet spout after the first selected period of time. In other aspects of the present invention, the controller includes an optional adjustment knob for adjusting the first selected period of time.

In further aspects of the present invention, the system comprises a second valve adapted to control fluid flow from a hot fluid source to the faucet spout, and a second "hot" switch that is normally deactivated and is touch activated by the user, wherein the controller is in communication with the second valve and the "hot" switch. In these aspects, the controller is configured to open the second valve when the hot switch is activated, thereby allowing fluid flow from the hot fluid source to the faucet spout, and to close the second valve after a second selected period of time after the hot switch is deactivated, thereby preventing fluid flow from the hot fluid source to the faucet spout after the second selected period of time.

In yet further aspects, in one embodiment the system comprises a third "warm" switch that is normally deactivated and is hand activated by the user, wherein the controller is in communication with the warm switch. In these further aspects, the controller is configured to open the first valve and the second valve when the warm switch is activated, thereby allowing fluid flow to the faucet spout from both the cold fluid source and the hot fluid source, and to close the first valve and the second valve after a third selected period of time after the third switch is deactivated, thereby preventing fluid flow to the faucet spout from the cold fluid source and the hot fluid source after the third selected period of time.

The present invention is also directed to a faucet control system for controlling fluid flow to a faucet spout in fluid communication with a cold fluid source delivering a first fluid and a hot fluid source delivering a second fluid. The system comprises a valve apparatus having an outlet connectable to the faucet spout, a first inlet connectable to the cold fluid source, and a second inlet connectable to the hot fluid source, a cold switch that is touch activated by a user of the system, a hot switch that is touch activated by the user and provides a sensor signal when activated, and a controller in communication with the valve apparatus, the cold switch, and the hot switch. The controller controls the valve apparatus to allow a proportion of the hot fluid and the cold fluid to be delivered to the faucet spout when a warm switch is activated.

Alternatively, a system may have first, second and third sensors. Touching the first hot sensor causes the controller to allow hot fluid to flow. Touching the second "cold" sensor causes cold water to flow. Touching the third sensor causes the controller to allow a mix of hot and cold fluid to flow.

In more detailed aspects, the first valve opens when power is provided to the first valve, the second valve opens when power is provided to the second valve, and the controller includes a first relay, a second relay, and a third relay. The first relay provides power to the first valve when the second sensor provides an initial sensor signal. The second relay provides power to the first valve and the second valve when the second sensor provides a first subsequent sensor signal after the initial sensor signal. The third relay provides power to the second valve when a third sensor provides a sensor signal.

A method comprises connecting the first inlet of a first valve to the cold fluid source, connecting the first outlet of the first valve to the faucet spout, connecting the second inlet of a second valve to the hot fluid source, connecting the second outlet of the second valve to the faucet spout, adhering a touch panel for activating the first valve and the second valve on a structure and at a location that is accessible to a user, and applying hand pressure to the touch panel to open one or both of the first valve and the second valve.

In detailed aspects, touching the touch panel comprises applying pressure to a first portion of the touch panel to allow a first proportion of the first fluid to the second fluid to be delivered to the faucet spout, applying pressure to a second portion of the touch panel to allow a second proportion of the first fluid to the second fluid to be delivered to the faucet spout, the second portion being different than the first proportion, and applying pressure to a third portion of the touch panel to allow a third proportion of the first fluid to the second fluid to be delivered to the faucet spout, the third proportion being different than the first and second proportion.

The present invention is also directed to a method comprising connecting an outlet of a valve apparatus to the faucet spout, connecting a first inlet of a valve apparatus to the cold fluid source, connecting a second inlet of the valve apparatus to the hot fluid source, mounting a first sensor at a first location spaced apart from the faucet spout, mounting a second sensor at a second location spaced apart from the faucet spout, activating the first sensor to allow a proportion of the first fluid to the second fluid to be delivered to the faucet spout, and activating the second sensor without touching the second sensor to alter the proportion of the first fluid to the second fluid. The method may also include mounting a third sensor at a third location, wherein touching the first sensor may cause cold water to flow, touching the second sensor causes hot water to flow, and touching the third sensor causes a mixture of hot and cold water to flow.

The features and advantages of the invention will be more readily understood from the following detailed description which should be read in conjunction with the accompanying drawings.

DETAILED DESCRIPTION OF THE PREFERRED EMBODIMENTS

Figure 1:
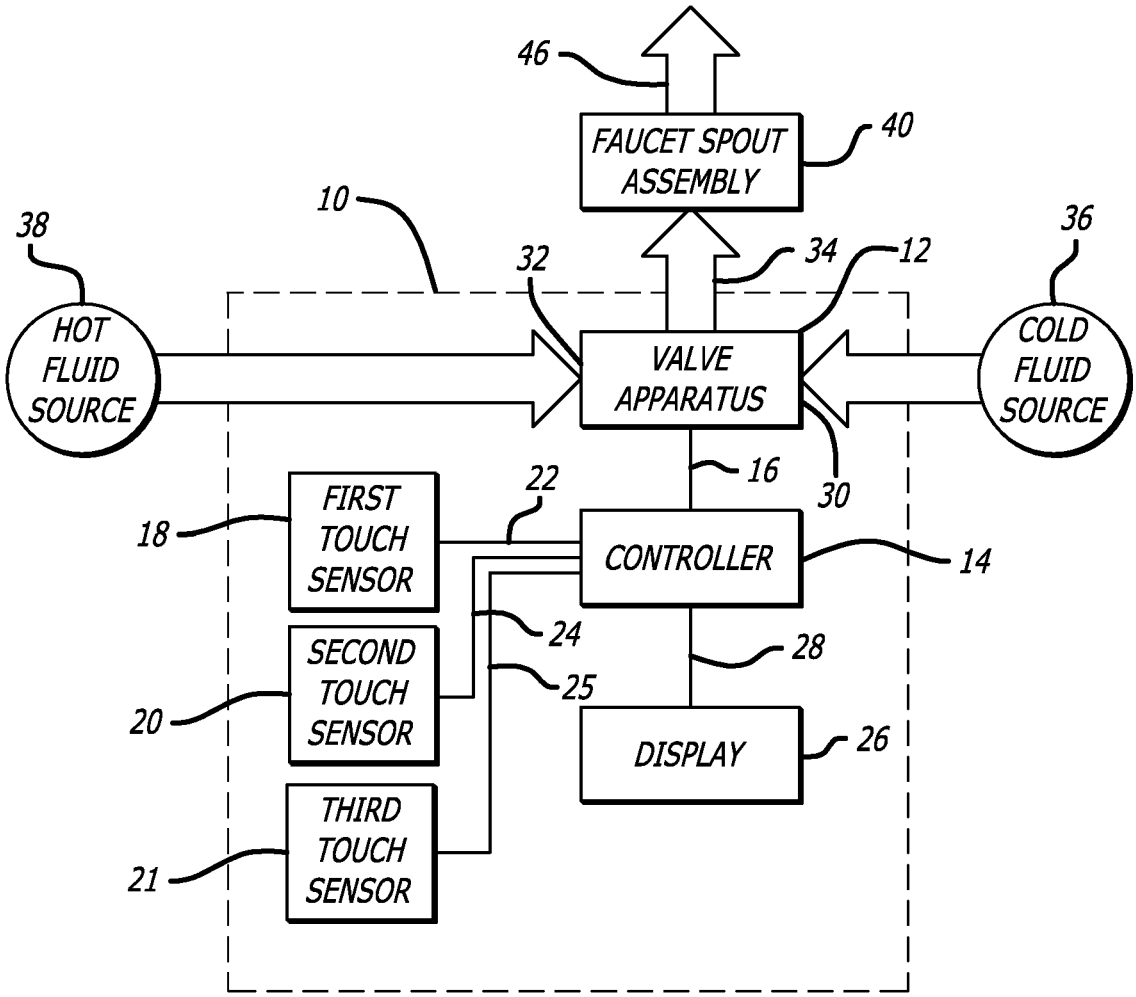
FIG. 1 is a block diagram of a faucet control system showing a valve apparatus, a controller, a first sensor, a second sensor, and a display.

Referring now in more detail to the exemplary drawings for purposes of illustrating embodiments of the invention, wherein like reference numerals designate corresponding or like elements among the several views, there is shown in FIG. 1 a block diagram of a faucet control system 10 having a valve apparatus 12 controlled by a controller 14 that provides a valve control signal 16 to the valve apparatus. The faucet control system also has a first sensor 18 and a second sensor 20 that provide a first sensor signal 22 and a second sensor signal 24, respectively, to the controller. An optional third sensor 21 provides a third sensor signal 25 to the controller. The faucet control system further has a visual display 26 for indicating temperature information in response to a display signal 28 from the controller.

The system may come in a one button/sensor, two button/sensor, three button/sensor or five button/sensor configuration. In a one button/sensor design, the user touches the button/sensor to initiate fluid flow. Each successive touch of the button/sensor causes a change in water temperature. In particular, each time the controller receives a signal from the button/sensor, the controller causes the valve apparatus to adjust the hot/cold mixture of water.

In a three sensor configuration, one sensor may be a "cold" button that is pressed to deliver relatively colder water. One sensor may be a "hot" button that is pressed to deliver relatively hotter water. A third sensor may be a "warm" button that is pressed to deliver relatively warm water. In an alternative two button/sensor system, a second sensor may be activated multiple times to provide progressively warmer water, with the valves of the hot and cold water controlled to allow more hot water to be added to the mix with each progressive push of the second button/sensor. It should be noted that the terms "first," "second" and "third" sensors may correspond to "hot," "cold" and "warm" sensors. But the terms are interchangeable, in that the "first" sensor may trigger flow of either "hot" or "cold" water, as desired by the system designer.

In an alternative, five button system, there is a "cold" water button, a "hot" water button, and three "warm" water buttons for various degrees of warm water. Pushing a first warm water button causes the system to deliver warm water of a certain degree. Pushing a third warm water button causes the system to deliver even warmer water.

Regarding FIG. 1, the valve apparatus 12 has a cold fluid inlet 30, a hot fluid inlet 32, and a fluid outlet 34. A cold fluid source 36 and a hot fluid source 38 are in fluid communication with the cold and hot fluid inlets, respectively. A faucet spout assembly 40 is in fluid communication with the outlet 34. In the embodiment shown, the cold and hot fluid sources and the faucet spout assembly are separate from the faucet control system 10.

Still referring to FIG. 1, the valve apparatus 12 allows a desired proportion of cold to hot fluid from fluid sources 38, 36 to be delivered to faucet spout assembly 40. As described in more detail below, the delivery of the desired proportion of cold to hot fluid is prescribed by a user of the faucet control system 10 by activating the first, second, and/or third sensors 18, 20, 21. For example, the user may desire that fluid exiting the faucet outlet 46 come from (i) only the cold fluid source 36, (ii) from both the cold and hot fluid sources 36, 38, or (iii) only from the hot fluid source 38. The first sensor 18 is used to provide hot fluid to the faucet spout assembly. The second sensor 20 is used to provide cold fluid to the faucet outlet 46. The third sensor 21 causes the hot and cold fluids to mix to provide warm water to the user.

Figure 2:
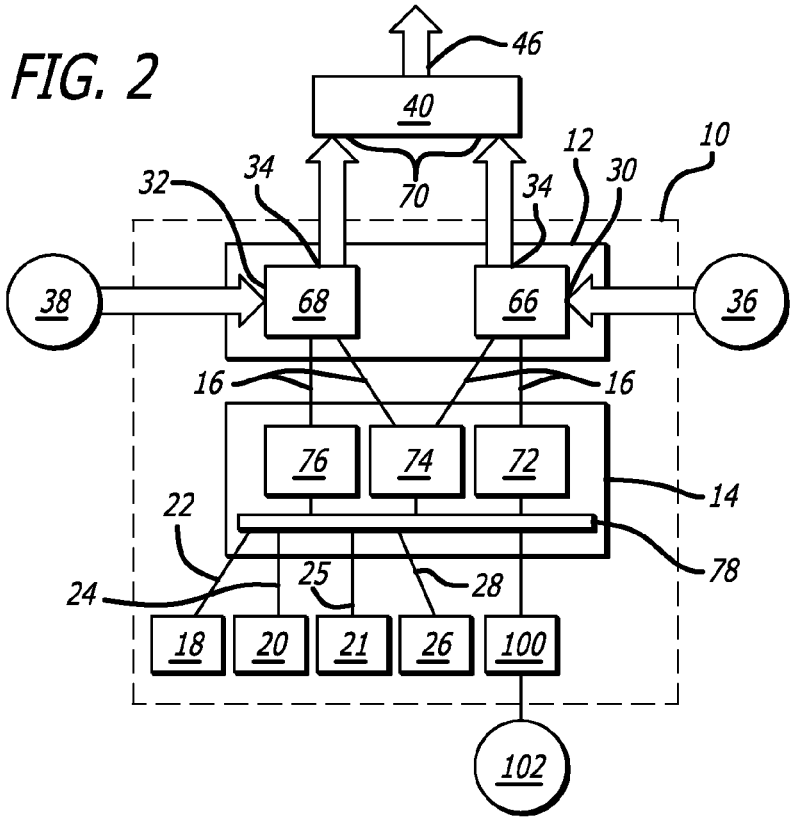
FIG. 2 is a block diagram of a faucet control system showing a valve apparatus having two valves controlled by a controller having a first relay device, second relay device, third relay device, and a circuit board.

Referring now to FIG. 2, the first, second, and third sensors 18, 20, and 21 preferably utilize touch pressure, such as from a user's fingers, to activate. When the first sensor 18 detects pressure of the user's hand, the first sensor provides the first sensor signal 22 to the controller 14. In response to the first sensor signal, the controller provides a first control signal 16A to the valve apparatus 12 so that a default proportion of cold to hot water begins to be delivered by valve apparatus to the faucet spout assembly 40. The first control signal 16A provided to the valve apparatus 12 may be an electrical current sufficient to actuate a motor or solenoid in the valve apparatus. The default proportion may be set so that only cold water is delivered to the faucet spout assembly when the first sensor initially detects the hand within its sensing range. Of course, the default proportion may also be set so that a particular mixture of cold and hot water is delivered or only hot water is delivered. When the hand stops touching the first sensor, the first sensor signal 22 is discontinued or altered. In response to cessation or alteration of the first sensor signal, the controller provides another first control signal 16B to the valve apparatus 12 so that water delivery to the faucet spout assembly is terminated. The second control signal 16B may be cessation of the electrical current being supplied to a motor or solenoid in the valve apparatus. The controller may be preprogrammed or configured to terminate water delivery after a predetermined time, such as a few or several seconds, after the hand stops touching the first sensor.

While water is being delivered to the faucet spout assembly 40, the user may press the third sensor 21. The third sensor provides a third sensor signal 25 to the controller 14. In response to the third sensor signal, the controller provides a third control signal to the valve apparatus 12 so as to progressively alter the proportion, ratio, or mixture of cold to hot water being delivered. In one embodiment, pressing the third sensor causes only a predetermined mixture of hot and cold water to be dispensed. But, in other embodiments, the mixture may be progressively changed with subsequent pushes of the button, as will be described. For example, the user may press the third sensor so that the water coming out of the faucet outlet 46 changes from mostly cold water to a first mixture of cold and hot water. The user may press the third sensor again so that the water coming out of the faucet outlet changes from the first mixture to a second mixture having a greater proportion of hot water. The user may press the third sensor yet again so that the water coming out of the faucet outlet changes to mostly hot water. The controller may be preprogrammed or configured so that if the user presses the third sensor a further time, the sequence starts over so that the water coming out of the faucet outlet changes to mostly cold water.

The optional display 26 is visible to the user of the faucet spout assembly 40. The display is configured to indicate the proportion of cold to hot water that the valve apparatus 12 is delivering to the faucet spout assembly. The display may include an alphanumeric display or a plurality of lights or light emitting diodes (LEDs) that are controlled by the display signal 28 provided by the controller 14. For example, the display may show the numeral one or illuminate one LED to indicate that only cold water is being delivered the faucet spout assembly. The display may show the numeral two or show two LEDs illuminated to indicate that the first mixture of cold and hot water is being delivered. Continuing further, the display may show the numeral three or illuminate three LEDs to indicate that the second mixture of water having a higher proportion of hot water is being delivered. Finally, the display may show the numeral four or illuminate four LEDs to indicate that only hot water is being delivered.

Referring again to FIGS. 2 and 3, the valve apparatus 12 may include one or more valves. For example, the valve apparatus may include one variably adjustable ball valve and a motor for moving the ball valve. The mixture of cold and hot fluid at any instant corresponds to the rotational position of the ball valve, which depends on the valve control signal 16 received by the valve apparatus from the controller 14. Other types of variably adjustable valves may also be used. The valve apparatus may include two or more solenoid valves.

Turning to FIG. 2, there is shown a block diagram of a faucet control system 10 having a valve apparatus 12 that includes a first valve 66 and a second valve 68 that are adapted to control delivery of cold and hot fluid respectively. The first valve has a cold fluid inlet 30 adapted to be coupled to a cold water source 36. The second valve has a hot fluid inlet 32 adapted to be coupled to a hot water source 38. The first and second valves each have a separate fluid outlet 34 adapted to be coupled to one of two fluid inlets 70 of the faucet spout assembly 40. The faucet spout assembly combines fluid entering the inlets 70 into one stream of fluid exiting a single faucet outlet 46. The first and second valves are moveable between a normally closed state and an actuated open state in response to valve control signals 16 provided by the controller 14. The first and second valves may include solenoids, motors, or other means of actuating an interior movable valve member to a fully open, partially closed, or fully closed position in response to valve control signals 16 provided by the controller 14.

Still referring to FIG. 2, the controller 14 includes a first relay device 72, a second relay device 74, a third relay device 76, and a circuit board 78. The relay devices 72, 74, 76 provide separate valve control signals 16 to the first and second valves 66, 68. The circuit board receives a first sensor signal 22 from the first sensor 18, receives a second sensor signal 24 from the second sensor 20, receives a third sensor signal 25 from the third sensor, and provides a display signal 28 to the display 26. The circuit board may include a microprocessor and other electronic components for separately activating and deactivating the relay devices 72, 74, 76 in response to the received sensor signals 22, 24, 25. The circuit board obtains power from a transformer 100 connected to a power source 102, such as a standard AC electrical outlet providing alternating current.

When the user momentarily presses a first "cold" sensor, a first sensor signal 22 is provided to the circuit board 78. In response to the first sensor signal, the circuit board activates the first relay device 72, which in turn provides a valve control signal 16 to the first valve 66. If hot or warm water is already flowing, the circuit board activates the second relay device 76, which in turn provides a signal to the third relay device 76, which in turn provides a valve control signal to the second valve 68, to move the valve to the normally closed position and to stop the flow of hot water. As a result, the first valve is moved from the normally closed to the open state so that cold water from the cold water source 36 is delivered to the faucet spout assembly 40. The second valve 68 remains in its normally closed state so that only cold water exits the faucet outlet 46. When the user momentarily presses the second "hot" sensor, a second sensor signal 24 is provided to the circuit board 78. In response to the second sensor signal, the circuit board activates the second relay device 72, which in turn provides a valve control signal to the appropriate values.

When the user momentarily presses the third sensor 21, another sensor signal 25 is provided to the circuit board 78. Through programming of a microprocessor using appropriate software or embedded commands or through other means, the circuit board activates the second relay device 74, which in turn provides a valve control signal 16 to both the first valve 66 and the second valve 68. As a result, the first valve remains in the open state and the second valve is moved from the normally closed state to the open state. In this way, cold and hot water from the cold and hot water sources 36, 38 are delivered to the faucet spout assembly 40 so that warm water exits the faucet outlet 46.

Figure 3:
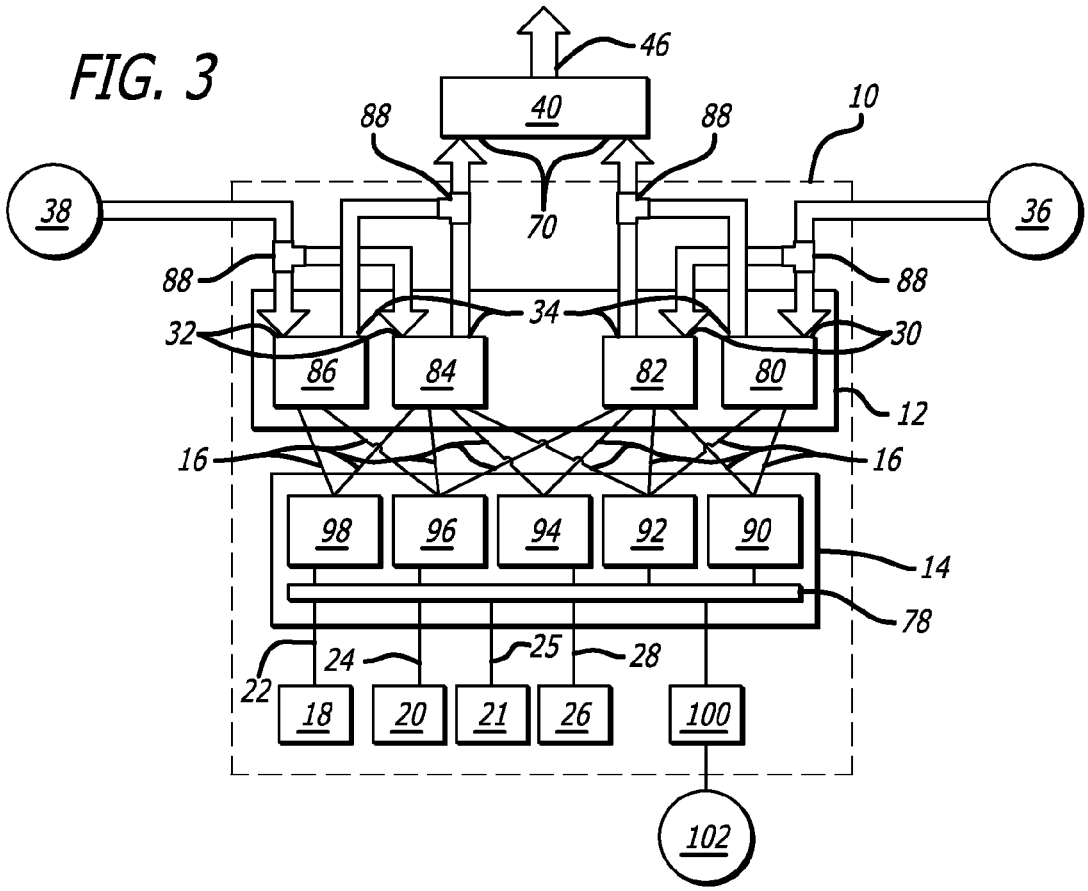
FIG. 3 is a block diagram of a faucet control system showing a valve apparatus with four valves controlled by a controller having five relay devices.

Greater control of the temperature of the water exiting the faucet outlet 46 would be achieved, for example, with the use of additional valves or relay devices. In FIG. 3 there is shown a block diagram of a faucet control system 10 having a valve apparatus 12 that includes four valves 80, 82, 84, 86 which control delivery of cold and hot fluid. The first and second valves 80, 82 each have a cold fluid inlet 30 adapted to be coupled to a cold water source 36 by means of a T-connector 88. The third and fourth valves 84, 86 each have a hot fluid inlet 32 adapted to be coupled to a hot water source 38 by means of another T-connector 88. The four valves each have a separate fluid outlet 34 adapted to be coupled to one of two fluid inlets 70 of the faucet spout assembly 40. In the embodiment shown, the outlets of the first and second valves are joined by a T-connector 88 that leads to one of the two fluid inlets 70 of the faucet spout assembly. The outlets of the third and fourth valves are joined by another T-connector 88 that leads to the other fluid inlet 70.

The faucet spout assembly 40 combines fluid entering the inlets 70 into one stream of fluid exiting a single faucet outlet 46. Each of the four valves 80, 82, 84, 86 are moveable between a normally closed state and an actuated open state in response to valve control signals 16 provided by the controller 14. Each of the four valves may include solenoids, motors, and other means of actuating an interior movable valve member to a fully open, partially closed, or fully closed position in response to valve control signals 16 provided by the controller 14.

Still referring to FIG. 3, the controller 14 includes a five relay devices 90, 92, 94, 96, 98 and a circuit board 78. Each of the relay devices provides separate valve control signals 16 to the valves 80, 82, 84, 86 as explained in greater detail below. The circuit board 78 receives a first sensor signal 22 from the first sensor 18, receives a second sensor signal 24 from the second sensor 20, receives a third sensor signal 25 from the third sensor 21, and provides a display signal 28 to the display 26. The circuit board may include a microprocessor and other electronic components for separately activating and deactivating the relay devices in response to the received sensor signals 22, 24, 25. The circuit board obtains power from a transformer 100 connected to a power source 102.

With continued reference to FIG. 3, when the user presses the second sensor 20, a second sensor signal 24 is momentarily provided to the circuit board 78. In response the circuit board activates the first relay device 90, which in turn provides a valve control signal 16 to the first and second valves 80, 82. As a result, the first and second valves are moved from the normally closed state to the open state so that cold water from the cold water source 36 is delivered to the faucet spout assembly 40. The third and fourth valves 84, 86 remain in their normally closed state so that only cold water exits the faucet outlet 46.

In a two-sensor embodiment, when the user touches the second sensor 20 for a second time, a second sensor signal 24 is again momentarily provided to the circuit board 78. Through programming of a microprocessor or other means, the circuit board deactivates the first relay device 90 and activates the second relay device 92, which in turn provides a valve control signal 16 the first, second, and third valves 80, 82, 84. As a result, the first and second valves 80, 82 remain in the open state and the third valve 84 is moved from the normally closed state to the open state. In this way, a two-to-one mixture of cold to hot water is delivered to the faucet spout assembly 40 so that slightly warm water exits the faucet outlet 46.

Again in the two-sensor embodiment, when the user touches the second sensor 20 for a third time, a second sensor signal 24 is yet again momentarily provided to the circuit board 78. The circuit board deactivates the second relay device 92 and activates the third relay device 94, which in turn provides a valve control signal 16 to only the second and third valves 82, 84. As a result, the first valve 80 returns to its normally closed state and second and third valves remain in the open state. In this way, a one-to-one ratio of cold to hot water is delivered to the faucet spout assembly 40 so that warm water exits the faucet outlet 46.

When the user touches the second sensor 20 for a fourth time, a second sensor signal 24 is again momentarily provided to the circuit board 78. The circuit board deactivates the third relay device 94 and activates the fourth relay device 96, which in turn provides a valve control signal 16 the second, third, and fourth valves 82, 84, 86. As a result, the second and third valves 82, 84 remain in the open state and the fourth valve 86 is moved from the normally closed state to the open state. In this way, a one-to-two ratio of cold to hot water is delivered to the faucet spout assembly 40 so that slightly warm water exits the faucet outlet 46.

When the user waves her hand within range of the second sensor 20 for a fifth time in the two-sensor embodiment, a second sensor signal 24 is momentarily provided to the circuit board 78. The circuit board deactivates the fourth relay device 96 and activates the fifth relay device 98, which in turn provides a valve control signal 16 to only the third and fourth valves 84, 86. As a result, the second valve 82 returns to its normally closed state and third and fourth valves remain in the open state. In this way, only hot water from the hot water source 38 is delivered to the faucet spout assembly 40.

Figure 4:
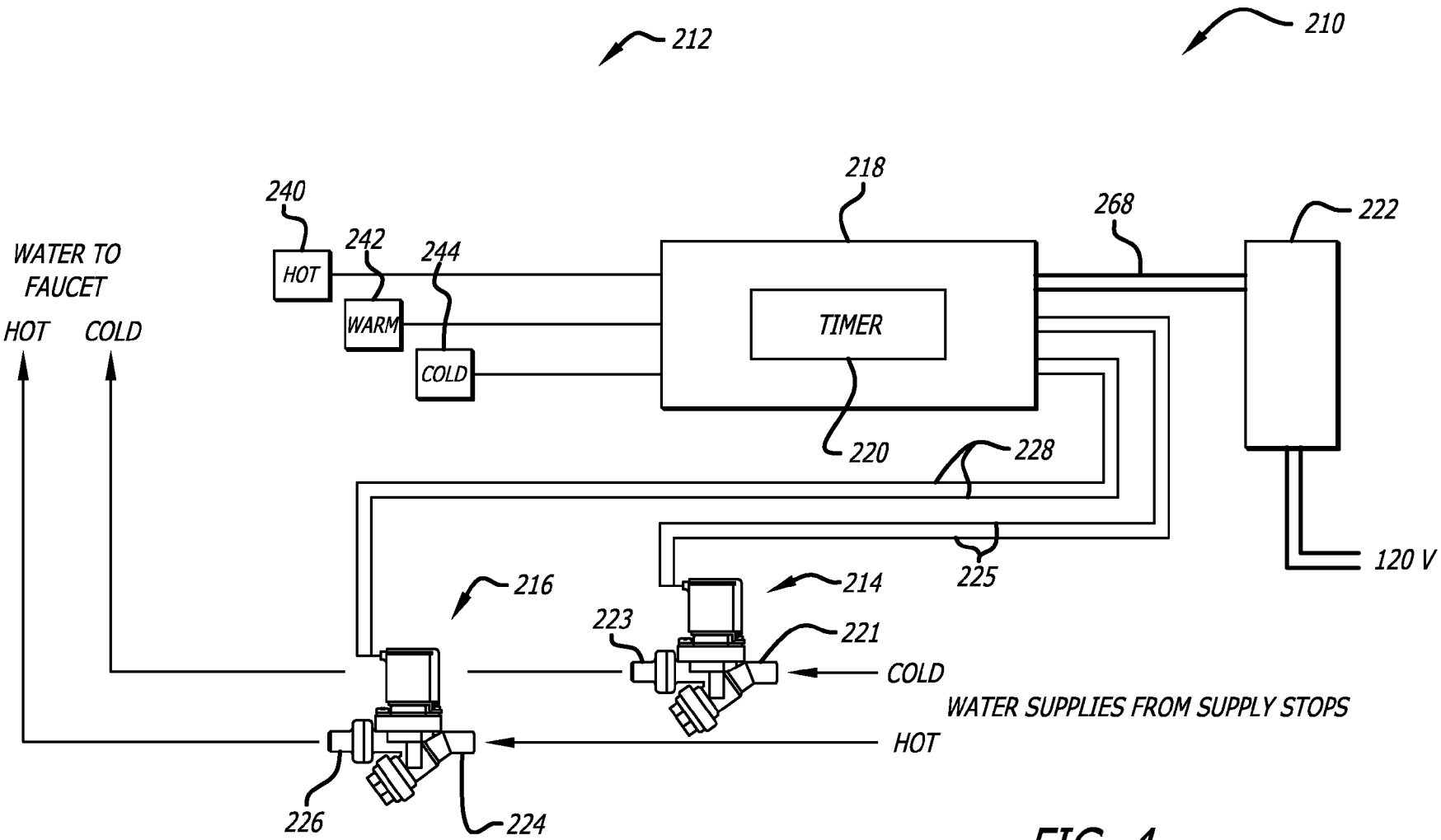
FIG. 4 is a block diagram of a timed faucet control system showing hot, warm, and cold touch sensors, solenoid valves, a controller having a timer and in communication with the touch panel and solenoid valves, and a power supply connected to the controller.

FIG. 4 shows a timed faucet control system 210 that comprises a touch sensor or panel 212, a first solenoid valve 214, a second solenoid valve 216, a controller 218 having a timer 220, and a power supply 222. The controller 218 is connected to a power supply 222 and is in communication with the touch panel 212 and the first and second solenoid valves 214, 216.

The power supply 222 is configured to accept 100-240 volts, 50/60 Hz power and to be plugged into a standard household power receptacle or outlet. The power supply 222 provides 12-volt DC power to the controller 218, although other voltages may be provided that are suitable for operating the first and second solenoid valves 214, 216.

The first solenoid valve 214 is adapted to provide cold water from a cold water source to a faucet. The first solenoid valve includes a first valve inlet 221 and a first valve outlet 223. The first valve inlet 221 is configured to be connected to the cold water source and may include standard threads or fittings that mate with household or commercial plumbing lines. The first valve outlet 223 is configured to be connected to a cold water inlet of the faucet. A pair of first valve electrical leads 225 connects the first solenoid valve 214 to the controller 218.

The second solenoid valve 216 is adapted to provide hot water from a hot water source to the faucet. The second solenoid valve includes a second valve inlet 224 and a second valve outlet 226. The second valve inlet 224 is configured to be connected to the hot water source and may include standard threads or fittings that mate with household or commercial plumbing lines. The second valve outlet 226 is configured to be connected to a hot water inlet of the faucet. A pair of second valve electrical leads 228 connects the second solenoid valve 216 to the controller 218.

Figure 5:
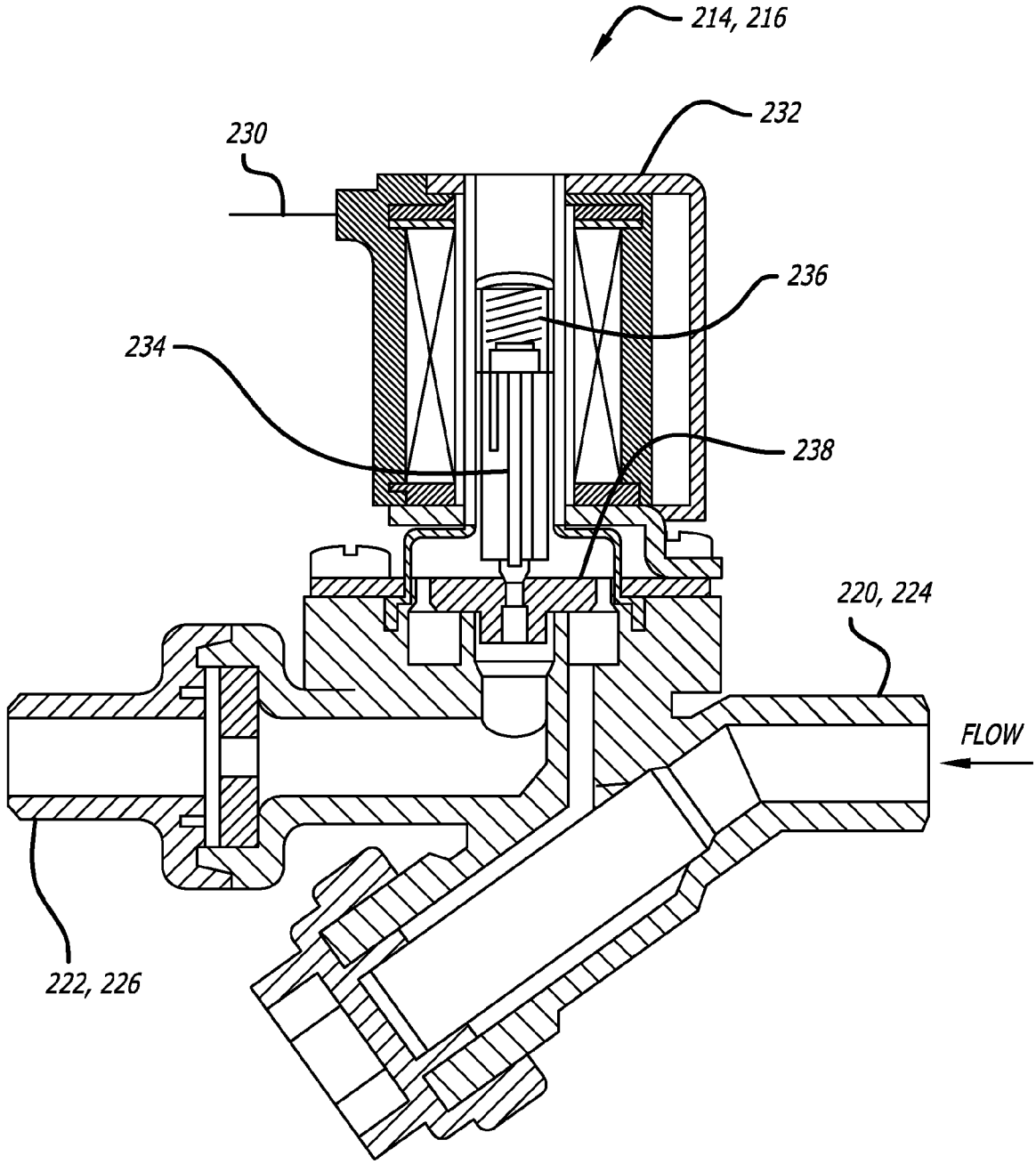
FIG. 5 is a cross-sectional view of the solenoid valves of FIG. 7 showing a fluid inlet, a fluid outlet, an electrical terminal, a moveable armature, a spring disposed at a first end of the armature, and a diaphragm disposed at a second end of the armature.

In FIG. 5 there is shown is a cross-sectional view of the first and second solenoid valves 214, 216. Each solenoid valve 214, 216 comprises electrical terminals 230 connected to a solenoid coil assembly 232, a moveable armature 234 disposed adjacent the coil assembly 232, a spring 236 disposed at first end of the armature 234, and a diaphragm 238 disposed at a second end of the armature 234 opposite the first end. The electrical terminals 230 of each valve 214, 216 connect to electrical leads 225, 228, respectively, and provide power or electrical current from the controller 218 to each valve. The spring 236 is configured to move the armature 234 to a closed orientation at which the diaphragm 238 prevents fluid flow through the valve 214, 216 by blocking the valve outlet 223, 226. The solenoid coil assembly 232 is configured to move the armature 234 from the closed orientation to an open orientation when power or electrical current is supplied by the controller 218 to the valve 214, 216. At the open orientation, the diaphragm 238 allows fluid flow through the valve outlet 223, 226.

Referring again to FIG. 4, the touch panel 212 includes three switches: a hot switch 240, a warm switch 242, and a cold switch 244. Each switch can be selectively activated and deactivated and is connected to the controller 218 by separate pairs of touch panel electrical leads 246. The switches 240, 242, 244 may be configured as mat switches described in U.S. Pat. No. 5,322,086 to Sullivan, the entire contents of which is incorporated herein by reference. Preferably, each mat switch 240, 242, 244 functions as a momentary-contact, normally-open, single-pole, single-throw switch. Each mat switch 240, 242, 244 preferably includes at least one pair of flexible conductive sheets. The flexible conductive sheets in each mat switch 240, 242, 244 are configured to be spaced apart in a normally-open configuration when no pressure is applied to an exposed outer surface adjacent to one of the flexible conductive sheets. The flexible conductive sheets in each mat switch 240, 242, 244 are also configured to make contact with each other when pressure is applied to the exposed outer surface of the touch panel 212. Preferably, the portions of the exposed outer surface corresponding to the hot switch 240, warm switch 242, and cold switch 244 are labeled to indicate hot, warm, and cold to allow a user to select the desired water temperature. The touch panel 212 also includes an unexposed outer surface which may be adhered or otherwise attached to a sink cabinet or other structure at a location that is accessible to a user of the timed faucet control system 210.

In other embodiments, each mat switch 240, 242, 244 includes additional pairs of flexible conductive sheets so as to form stacked mat switches, wherein additional pressure applied to the exposed outer surface of the touch panel 212 causes the additional pairs of flexible conductive sheets to make contact with each other.

Figure 6:
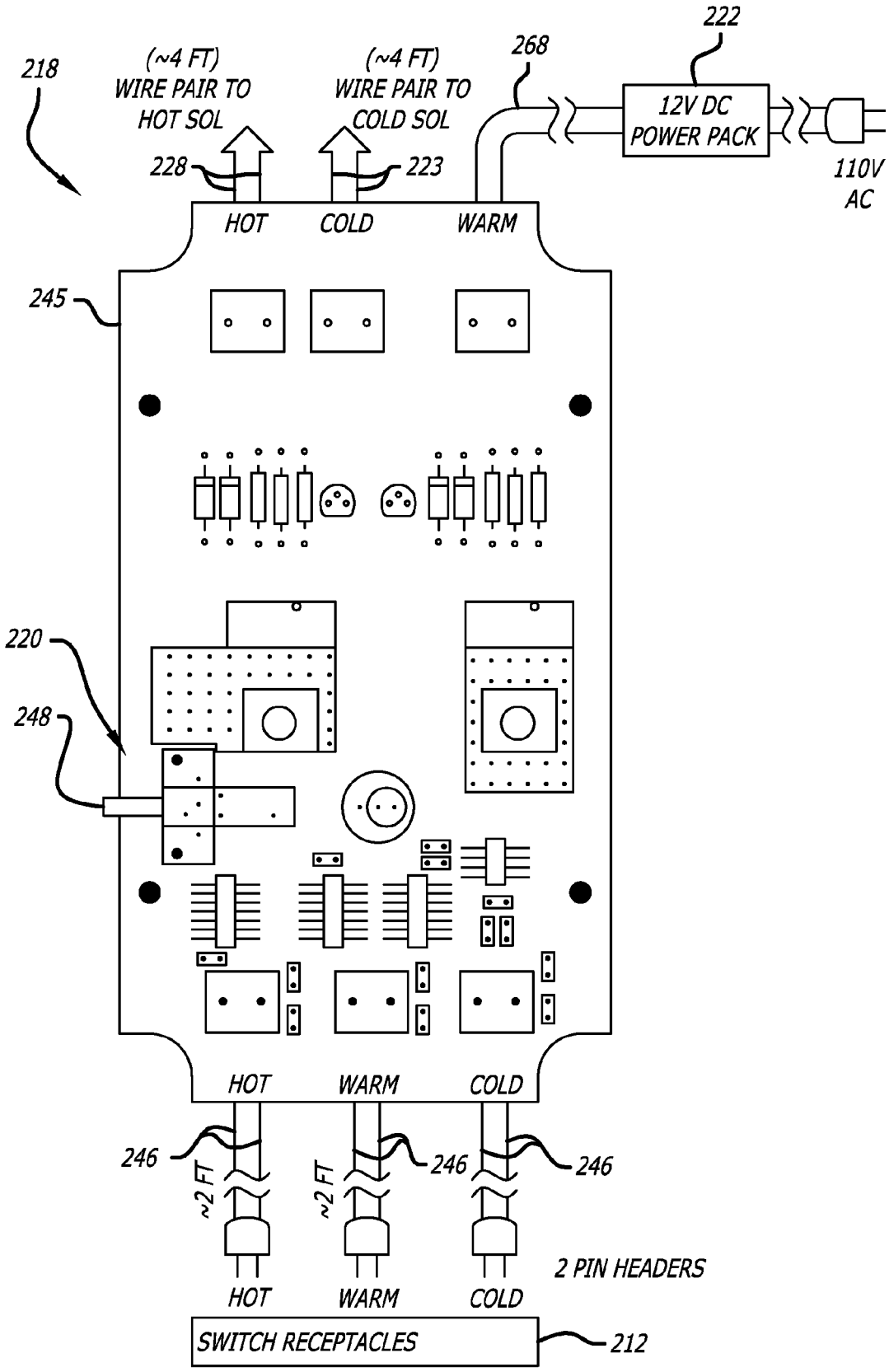
FIG. 6 is a plan view of a circuit board within the controller of FIG. 7 showing electronic components, a timer adjustment knob, connections to the solenoids, an optional touch panel, and the power supply.

Turning now to FIG. 6, the controller 218 includes a circuit board 245 with electrical components. The circuit board includes connections to the power supply 222, the first valve electrical leads 225, the second valve electrical leads 228, and the touch panel electrical leads 246. The timer 220 of the controller 218 has an adjustment knob 248. The adjustment knob 248 may be connected to a potentiometer or manually adjustable resistor.

The controller 218 is configured to provide current or power only to the first solenoid valve 214 when pressure is applied to the cold switch 244 of the touch panel 212, such that cold water from a cold water supply is delivered through the first solenoid valve to a cold water inlet of a faucet. The controller 218 is also configured to provide current or power only to the second solenoid valve 216 when pressure is applied to the hot switch 240 of the touch panel 212, such that hot water from a hot water supply is delivered through the second solenoid valve to a hot water inlet of the faucet. The controller 218 is further configured to provide current or power to both the first and the second solenoid valves 214, 216 when pressure is applied to the warm switch 242 of the touch panel 212, such that cold and hot water is delivered simultaneously to the respective cold and hot water inlets of the faucet so that warm water flows out of the faucet. In this way, cold, warm, or hot water flows out of the faucet when the cold switch 244, warm switch 242, or hot switch 240 of the touch panel 212 is activated with pressure.

The controller 218 is also configured to continue providing current or power to one or both of the valves 214, 216 after pressure is removed from the touch panel 212 such that the desired water temperature continues to be delivered to the faucet. In this way, water continues to be delivered to the faucet after the switches 240, 242, 244 have been deactivated. It will be appreciated that a user of the timed faucet control system 210 need not apply pressure continuously to the touch panel 212 in order to have water at a desired temperature flow out of the faucet continuously.

The controller 218 is further configured by means of the timer 220 to automatically discontinue providing one or both of the valves 214, 216 with power or current after a selected amount of time has past after the switches 240, 242, 244 have been deactivated with removal of pressure from the touch panel 212. In this way, water automatically ceases to flow out of the faucet after the selected period of time. The period of time may be selected by a user as desired by rotating or otherwise changing the position of the adjustment knob 248. It will be appreciated that a user of the timed faucet control system 210 need not touch the faucet or any portion of the system 210 after the user washes his or her hands in order to maintain cleanliness.

In another embodiment having stacked mat switches, the valves 214, 216 are configured to have more than one stage of opening or fluid flow, wherein more fluid flow or a higher flow rate is permitted when the valve 214, 216 is at a relatively high stage open condition. In such an embodiment, the controller 218 is configured to provide power or current to one or both valves 214, 216 such that the valve(s) has a low open condition when a first amount of pressure is applied to either switch 240, 242, 244 on the touch panel 212. The controller 218 is further configured to provide power or current to one or both valves 214, 216 such that the valve(s) has a high open condition when a second amount of pressure, greater than the first amount of pressure, is applied to either switch 240, 242, 244 on the touch panel 212. When the second amount of pressure is applied, two or more pairs of flexible conductive sheets within the activated switch 240, 242, 244 make contact with each other, which is detected by the controller 218. In response to detecting the contacts, the controller 218 provides signals, power, or current to the valves 214, 216 so that fluid flows out of the faucet at a higher rate of flow.

Figure 7:
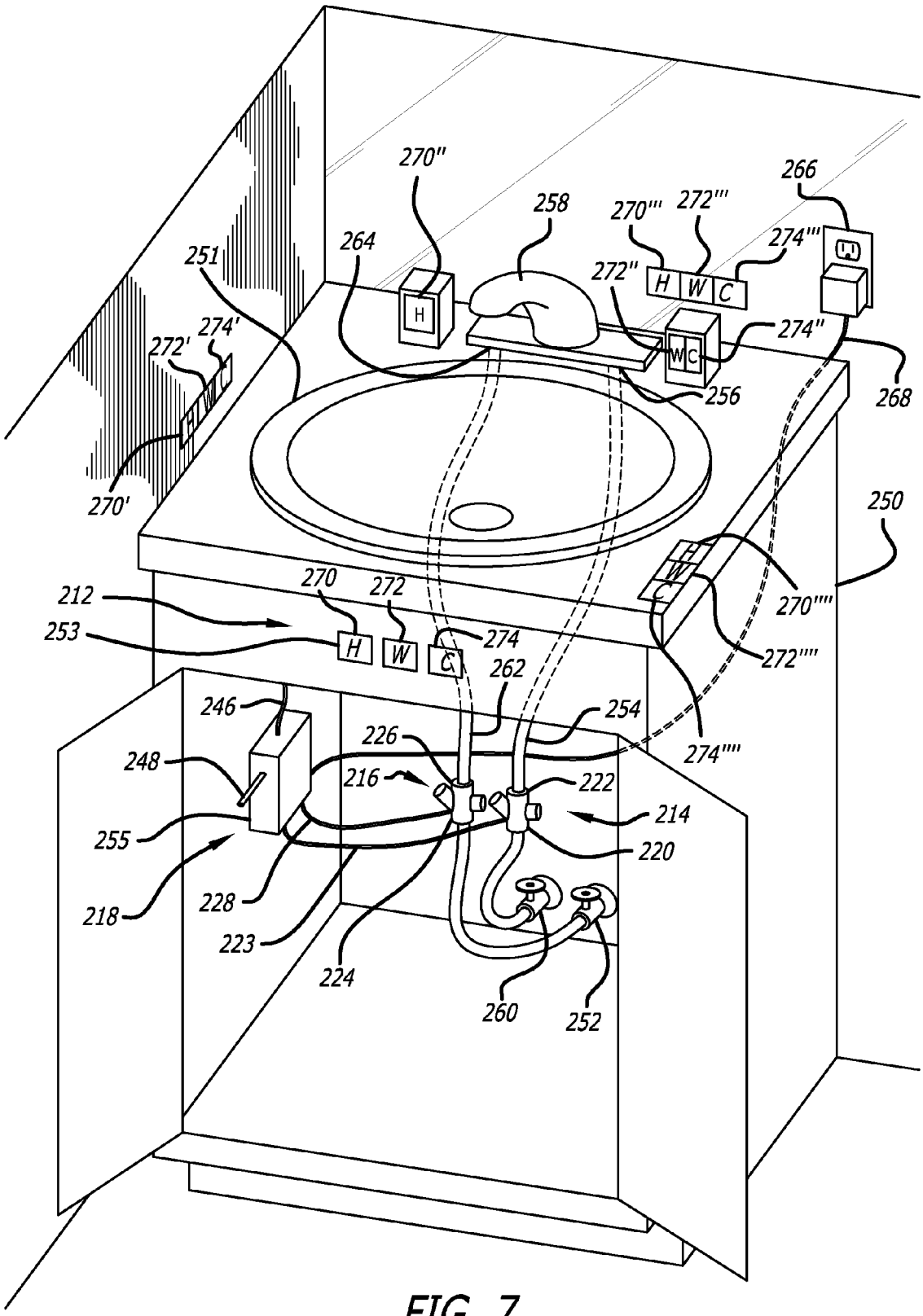
FIG. 7 is a perspective view of a sink cabinet with a sink showing the touch disposed on an exposed surface of the sink cabinet with alternative placements of the pods on a side of the sink, in a cut-out of the mirror, on fixtures where faucet handles would normally go, and on the wall. The solenoid valves are shown connected to water supplies, the power supply plugged into an electrical wall outlet, and the controller mounted within the cabinet.

Referring now to FIG. 7, the timed faucet control system 210 is shown installed in a sink cabinet 250 with a sink 251. The first solenoid valve 214 is connected to a cold water supply 252 beneath the sink 251 and is connected by means of a cold water conduit 254 to a cold water inlet 256 of a faucet 258 adjacent the sink 251. The second solenoid valve 216 is connected to a hot water supply 260 also beneath the sink 251 and is connected by means of a hot water conduit 262 to a hot water inlet 264 of the faucet 258. The power supply 222 is plugged into an electrical wall outlet 266 and is connected by means of power leads 268 to the controller 218, which is mounted inside the cabinet 250. The timer adjustment knob 248 is shown protruding from a cover 255 that protects the circuit board 245 of the controller 218. In this way, the knob 248 is easily accessible.

FIG. 7 shows many alternative placements of the touch pads 270, 272, and 274. One possible placement is on the front of the cabinet, as is seen with pads 270, 272 and 274. An alternative placement is on a wall near where a light switch would typically be found. This placement is seen with touch pads 270', 272' and 274', which may optionally be a continuous touch pad as illustrated in FIG. 6.

Another alternative placement is to put the touch pads where the hot and cold water handles would go on a traditional sink. Hence, FIG. 7 shows a cube on which is mounted a touch sensor for hot water 270". A second cube occupies the place where a hot water handle would normally go. Touch pads 272" and 274" are mounted on this second cube.

A further alternative placement is to put the touch pads on the mirror. In particular, touch pads 270", 272" and 274" are mounted in a recess that has been cut into a mirror (mirror not shown). Another alternative placement is to put the touch pads 270"", 272"" and 274"" along the right edge of the sink top.

These various placement alternatives provide the user with a multitude of choices as to where the touch pads should be placed. This is a considerable improvement over hot and cold water handles of the prior art.

Figure 8:
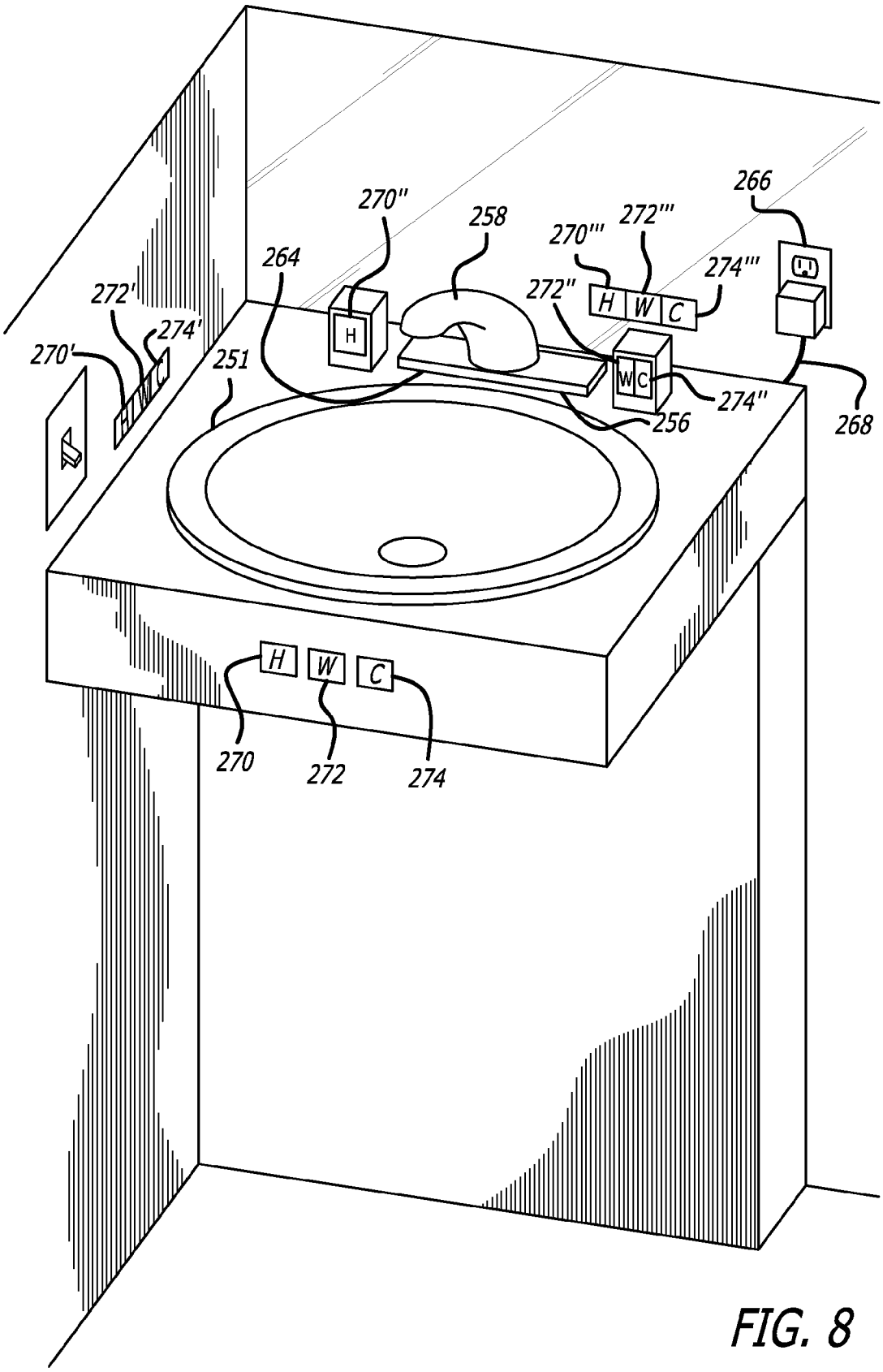
FIG. 8 is a perspective view of an alternative embodiment of a sink, with room underneath for a person in a wheelchair to access the sink.

FIG. 8 illustrates a configuration similar to FIG. 7. But space is provided beneath the sink for a user to place their knees when in a wheelchair or the like. Numerous different sink configurations may be implemented in conjunction with the present invention.

An embodiment of a method in accordance with the invention will now be described. Although the method will be described in connection with the timed faucet control system 210 of FIGS. 7-10, it will be appreciated that other systems may be used to implement the method.

In operation, the user momentarily touches or otherwise applies pressure to a portion of the touch panel 212 thereby activating any one of the mat switches 240, 242, 244 corresponding to the desired water temperature. Preferably, only the user's hand or fingers applies pressure to the touch panel. The controller 218 detects the applied pressure and begins to provide power or current to one or both valves 214, 216 in response to the detected pressure, such that water flows out of the faucet at the desired temperature. After the user discontinues the application of pressure to the touch panel 212, the controller 218 keeps the valve or valves 214, 216 open by continuing to provide power or current to the valve or valves 214, 216 for a selected amount of time associated with present position of the adjustment knob 248 on the timer 220 of the controller 218. After the selected amount of time has elapsed, the controller 218 automatically discontinues providing power or current to the valve or valves 214, 216, thereby closing the valves or valves 214, 216.

While several particular forms of the invention have been illustrated and described, it will also be apparent that various modifications can be made without departing from the scope of the invention. For example, touch sensors may be built into handles at either side of the spout and/or on the spout itself. Showers and bathtubs may be adapted to include touch sensors and may be used in conjunction with the current approach. For example, a touch pad or other touch sensors may be touched by the user to initiate and/or change the temperature of flowing water. A timer may also be optionally added, such that the user touches a timer pad to increase and/or change a default amount of time that the water is allowed to run.

It is also contemplated that various combinations or subcombinations of the specific features and aspects of the disclosed embodiments can be combined with or substituted for one another in order to form varying modes of the invention. Accordingly, it is not intended that the invention be limited, except as by the appended claims.

I claim:

1. A faucet control system for controlling fluid flow to a faucet spout in fluid communication with a cold fluid source delivering a first fluid and a hot fluid source delivering a second fluid, the system comprising:

a valve apparatus having an outlet connectable to the faucet spout, a first inlet connectable to the cold fluid source, and a second inlet connectable to the hot fluid source;

a first sensor that is activated by a user of the system;

a second sensor that is activated by the user and provides a sensor signal when activated; and a controller in communication with the valve apparatus, the first sensor, and the second sensor, the controller controls the valve apparatus to allow a proportion of the first fluid to the second fluid to be delivered to the faucet spout when the first sensor is activated, and to alter the proportion when the second sensor is activated;

wherein:

the valve apparatus includes a first valve adapted to be connected to the cold fluid source and a second valve adapted to be connected to the hot fluid source;

the controller controls the first valve and the second valve such that a first proportion of the first fluid to the second fluid is delivered to the faucet spout when the second sensor provides an initial sensor signal;

the controller controls the first valve and the second valve such that a second proportion of the first fluid to the second fluid is delivered to the faucet spout when the second sensor provides a first subsequent sensor signal after the initial sensor signal, the second proportion being different than the first proportion;

the controller controls the first valve and the second valve such that a third proportion of the first fluid to the second fluid is delivered to the faucet spout when the second sensor provides a second subsequent sensor signal after the first subsequent sensor signal, the third proportion being different than the first proportion and the second proportion;

the first valve opens when power is provided to the first valve;

the second valve opens when power is provided to the second valve; and the controller includes a first relay, a second relay, and a third relay, the first relay provides power to the first valve when the second sensor provides an initial sensor signal, the second relay provides power to the first valve and the second valve when the second sensor provides a first subsequent sensor signal after the initial sensor signal, and the third relay provides power to the second valve when the second sensor provides a second subsequent sensor signal after the first subsequent sensor signal.

2. The system of claim 1 wherein the second sensor is adapted to be mounted at a location spaced apart from the faucet spout and includes a sensing element having a sensing range, and the second sensor activates when the hand of the user is within the sensing range.

3. A method of controlling fluid flow to a faucet spout in fluid communication with a cold fluid source delivering a first fluid and hot fluid source delivering a second fluid, the method comprising: connecting the first inlet of a first valve to the cold fluid source; connecting the first outlet of the first valve to the faucet spout; connecting the second inlet of a second valve to the hot fluid source; connecting the second outlet of the second valve to the faucet spout; adhering a touch panel for activating the first valve and the second valve on a structure and at a location that is accessible to a user; and applying hand pressure to the touch panel to open one or both of the first valve and the second valve;

wherein applying hand pressure to the touch panel comprises:

applying pressure to a first portion of the touch panel to allow a first proportion of the first fluid to the second fluid to be delivered to the faucet spout;

applying pressure to a second portion of the touch panel to allow a second proportion of the first fluid to the second fluid to be delivered to the faucet spout, the second portion being different than the first proportion; and applying pressure to a third portion of the touch panel to allow a third proportion of the first fluid to the second fluid to be delivered to the faucet spout, the third proportion being different than the first and second proportion.

4. The method of claim 3 further comprising:

removing hand pressure from the touch panel; and stopping fluid flow to the faucet spout at a selected time period after hand pressure is removed from the touch panel;

altering the selected time period, including manipulating an adjustment knob on a controller in communication with the first valve, the second valve, and the touch panel.

5. A method of controlling fluid flow to a faucet spout in fluid communication with a cold fluid source delivering a first fluid and hot fluid source delivering a second fluid, the method comprising:

connecting an outlet of a valve apparatus to the faucet spout;

connecting a first inlet of a valve apparatus to the cold fluid source;

connecting a second inlet of the valve apparatus to the hot fluid source;

mounting a first sensor at a first location spaced apart from the faucet spout;

mounting a second sensor at a second location spaced apart from the faucet spout;

activating the first sensor by touching the first sensor to allow a proportion of the first fluid to the second fluid to be delivered to the faucet spout; and activating the second sensor by touching the second sensor to alter the proportion of the first fluid to the second fluid wherein mounting the first sensor includes mounting the first sensor in a recess in a mirror.

6. A method of controlling fluid flow to a faucet spout in fluid communication with a cold fluid source delivering a first fluid and hot fluid source delivering a second fluid, the method comprising:

connecting an outlet of a valve apparatus to the faucet spout;

connecting a first inlet of a valve apparatus to the cold fluid source;

connecting a second inlet of the valve apparatus to the hot fluid source;

mounting a first sensor at a first location spaced apart from the faucet spout;

mounting a second sensor at a second location spaced apart from the faucet spout;

activating the first sensor by touching the first sensor to allow a proportion of the first fluid to the second fluid to be delivered to the faucet spout; and activating the second sensor by touching the second sensor to alter the proportion of the first fluid to the second fluid;

wherein mounting the first sensor includes mounting the first sensor on a cube in a location adjacent to a spout.

7. A method of controlling fluid flow to a faucet spout in fluid communication with a cold fluid source delivering a first fluid and hot fluid source delivering a second fluid, the method comprising:

connecting an outlet of a valve apparatus to the faucet spout;

connecting a first inlet of a valve apparatus to the cold fluid source;

connecting a second inlet of the valve apparatus to the hot fluid source;

mounting a first sensor at a first location spaced apart from the faucet spout;

mounting a second sensor at a second location spaced apart from the faucet spout;

activating the first sensor by touching the first sensor to allow a proportion of the first fluid to the second fluid to be delivered to the faucet spout; and activating the second sensor by touching the second sensor to alter the proportion of the first fluid to the second fluid;

wherein mounting the first sensor includes mounting the first sensor on a spout.

8. A method of controlling fluid flow to a faucet spout in fluid communication with a cold fluid source delivering a first fluid and hot fluid source delivering a second fluid, the method comprising:

connecting an outlet of a valve apparatus to the faucet spout;

connecting a first inlet of a valve apparatus to the cold fluid source;

connecting a second inlet of the valve apparatus to the hot fluid source;

mounting a first sensor at a first location spaced apart from the faucet spout;

mounting a second sensor at a second location spaced apart from the faucet spout;

activating the first sensor by touching the first sensor to allow a proportion of the first fluid to the second fluid to be delivered to the faucet spout; and activating the second sensor by touching the second sensor to alter the proportion of the first fluid to the second fluid;

wherein the method includes the step of mounting third, fourth and fifth sensors for activating various degrees of warm water flow.

* * * * *